United States Patent [19]

Husges et al.

[11] 4,136,911

[45] Jan. 30, 1979

[54] APPARATUS FOR FEEDING A CARD WITH FIBER MATERIAL

[75] Inventors: Gerd Husges; Rupert Karl, both of Ingolstadt, Fed. Rep. of Germany

[73] Assignee: Schubert & Salzer, Ingolstadt, Fed. Rep. of Germany

[21] Appl. No.: 815,922

[22] Filed: Jul. 15, 1977

[30] Foreign Application Priority Data

Jul. 30, 1976 [DE] Fed. Rep. of Germany ..... 2634250

[51] Int. Cl.[2] ..... B65G 53/40; D01G 15/40

[52] U.S. Cl. ..... 302/59; 19/105; 55/454; 55/459 B

[58] Field of Search ..... 302/28, 59, 60, 61; 19/105, 205; 209/143, 144; 55/454, 459 B, 460

[56] References Cited

U.S. PATENT DOCUMENTS

| | | | |
|---|---|---|---|
| 3,708,210 | 1/1973 | Stähel et al. | 302/59 |
| 3,787,093 | 1/1974 | Hanselmann et al. | 302/61 |
| 4,028,076 | 6/1977 | Fields | 55/459 B X |

*Primary Examiner*—Evon C. Blunk
*Assistant Examiner*—James L. Rowland
*Attorney, Agent, or Firm*—Bailey, Dority & Flint

[57] ABSTRACT

An apparatus for feeding a carding machine with fiber material having a shaft which is fed by a preceding feed shaft. The fiber material is conveyed into the feed shaft by means of a stream of air flowing through a conveying conduit. An air circulating passage is connected between the feed shaft and the filling shaft. An air conveying device is disposed in the air circulating passage for conveying the stream of air emerging from the feed shaft into the filling shaft for compressing the fiber material therein.

5 Claims, 3 Drawing Figures

APPARATUS FOR FEEDING A CARD WITH FIBER MATERIAL

BACKGROUND OF THE INVENTION

The present invention relates to an apparatus for feeding a card with fiber material having a filling shaft which is fed by a preceding feed shaft. The fiber material is conveyed into the feed shaft via a conveying conduit by means of a stream of air.

It is known to provide a feed shaft in front of a filling shaft associated with a card and to supply the fiber material present in the feed shaft, by means of a conveying roller, to an opening roller which then delivers it to the filling shaft (DT-PS 1.202.193; Textilbertrieb, 1975, No. 8, page 96; Prospectus "Superkarde KU 12 mit Flockenspeisung FL 12" of Schubert & Salzer Maschinenfabrik AG). These known feed apparatus require two streams of air, one of which serves as a stream of conveying air for the fiber material to be fed into the feed shaft and the second stream of air, which is produced intermittently by means of a piston displaced in a cylinder or continuously by a blower, takes over the compression of the fiber material in the filling shaft. After passing through the appropriate shaft, the two streams of air emerge again from the shafts provided with outlets at the lower end. In order to prevent contamination of the free atmosphere by the streams of air leaving the shafts laden with dust, it is known to supply these two streams of air to the extraction installation of the card. It is a disadvantage of this solution, however, that the filters present in the card extractor are not sufficient for the additional cleansing of the two streams of air and it is, therefore, necessary to exchange these filters for ones having a greater capacity. This leads to increased constructional expense and is costly. A further disadvantage consists in the fact that air laden with dirt is drawn in from the spinning room to compress the fiber material present in the filling shaft, as a result of which both the air-conveying elements and also the fiber material in the filling shaft are contaminated.

SUMMARY OF THE INVENTION

According to the invention, this problem is solved, in an apparatus of the kind referred to above, by providing an air circulating passage through which the stream of air emerging from the feed shaft can be conveyed into the filling shaft to compress the fiber material.

Thus, it is now possible to use the stream of air serving as a stream of conveying air simultaneously for the compression of the fiber material in the filling shaft, so that only one stream of air has to be reprocessed. The filter capacity necessary for cleansing the stream of air is accordingly reduced to half what was heretofore needed. The reduced filter capacity is sufficient to carry out the cleansing of this one stream of air with the existing filters of the card extractor, without additional expense.

An air conveying device connected to the filling shaft is preferably provided in the air circulating passage. As a result of the fact that a cleansing device for the stream of air emerging from the feed shaft is disposed in the air circulating passage, the effect is achieved that dirt and dust contained in this stream of air are separated out and are not deposited in the section of the air circulating passage following the cleansing device. In a simple, inexpensive embodiment, the cleansing device consists of an air deflection device. A pipeline for removing the impurities separated out can be connected to the cleansing device.

Accordingly, it is an important object of the present invention to provide an apparatus which reprocesses two streams of air utilized in conveying fibers to a feed shaft and filling shaft of a carding machine in a simple and economical manner.

Another important object of the present invention is to utilize a single, continuous stream of air for feeding fibers through a feed shaft and filling shaft of a carding machine while removing impurities therefrom.

These and other objects and advantages of the invention will become apparent upon reference to the following specification, attendant claims and drawings.

DESCRIPTION OF THE PREFERRED EMBODIMENT

Figure 2:
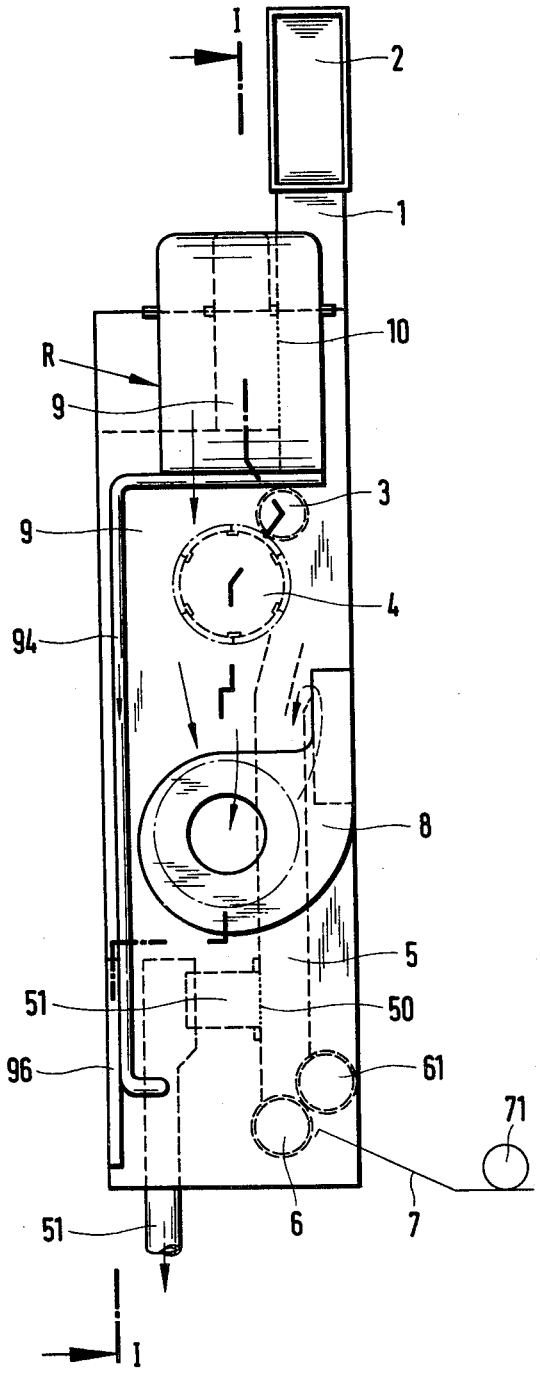
FIG. 2 is a sectional view taken along line 2—2 of FIG. 1.
Figure 3:
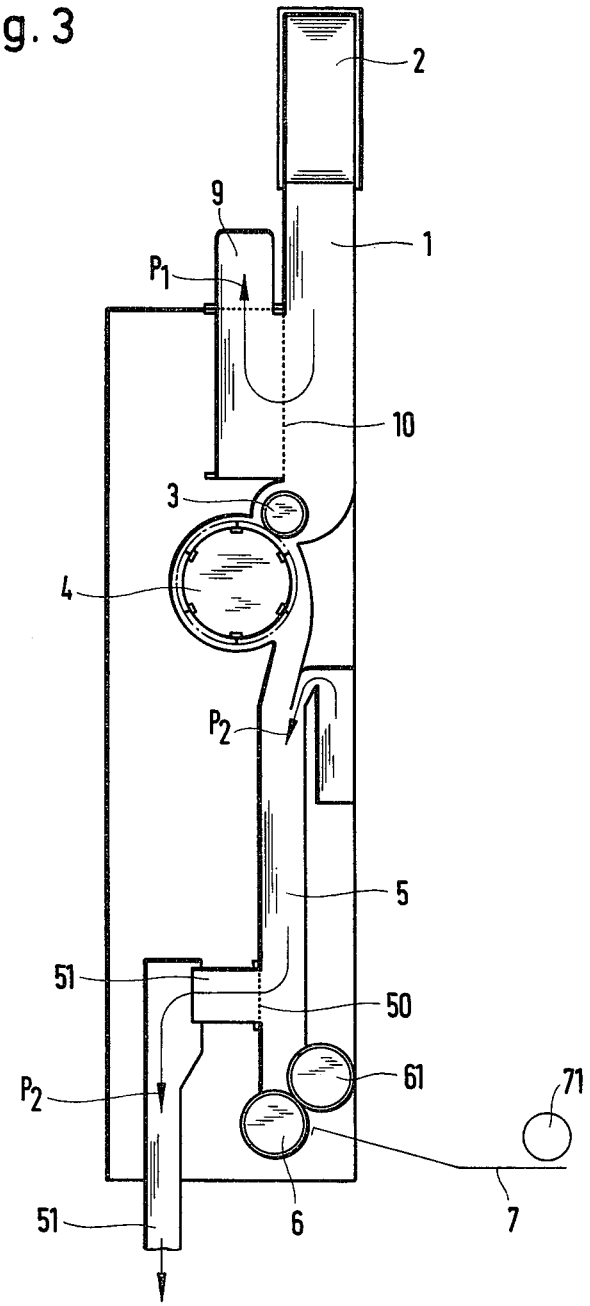
FIG. 3 is a sectional view taken along line 3—3 of FIG. 1.

The feed apparatus comprises a vertically disposed feed shaft 1 into which fiber material separated into flocks is blown through a pipeline 2 by means of a first stream of air $P_1$ which is generally termed the conveying stream of air. In its lower portion, the feed shaft 1 has openings 10 from which the stream of air $P_1$ emerges after passing through the feed shaft 1. At the lower end of the feed shaft 1, a conveying roller 3 is rotatably mounted which supplies the fiber material to an opening roller 4. The opening roller 4 causes a fine separation of the fiber material and drops it into a following filling shaft 5 at the outlet of which there is disposed a pair of delivery rollers 6 and 61. The delivery rollers 6 and 61, which are disposed spaced apart from one another, convey the fiber material out of the filling shaft 5 to the feed mechanism of a card which is indicated by a feed table 7 with a feed roll 71 (FIGS. 2 and 3).

Disposed laterally of the filling shaft 5 as an air conveying device is a blower 8 which is driven in an appropriate manner via a drive pulley 81 and continuously supplies a second stream of air $P_2$ to the filling shaft 5. The stream of air $P_2$ is blown by the blower 8 through a lateral opening in the wall of the filling shaft, into the filling shaft 5 and leaves the filling shaft 5 through apertures 50 after it has flowed through the fiber material present therein and compressed it (FIGS. 2, 3). From the apertures 50, a pipeline 51 leads to the card extractor (not shown).

In addition to this known arrangement, the feed apparatus comprises an air circulating passage 9 which communicates with the openings 10 of the feed shaft 1. The air circulating passage 9 at first extends horizontally, substantially parallel to the wall of the feed shaft 1 comprising the openings 10 and then extends downwards in the vertical direction to the blower 8 which it surrounds like a housing.

The air circulating passage 9 has the effect that the stream of air $P_1$, which conveys the fiber material through the pipeline 2 into the feed shaft 1, after emergining from the feed shaft 1 through the apertures 10 is taken to the intake side of the blower 8 and is then blown, by this, into the filling shaft 5 as a stream of air $P_2$. Thus, the stream of air $P_1$ is not only used, as heretofore usual, to convey the fiber material into the feed shaft, but at the same time, to compress the fiber material present in the filling shaft 5. Thus, the two air streams which heretofore had to be reprocessed are reduced to one and, accordingly, the necessary filter capacity for cleansing the stream of air is also reduced to half.

It is an advantage to provide a cleansing device R in the air circulating passage 9 to separate particles of dirt and dust entrained by the stream of air $P_1$ out of it and so to prevent these impurities form being deposited in the following air circulating passage 9 and the blower as well as in the fiber material present in the filling shaft 5. In the present case, the cleansing device 90 consists of an air deflection device in the form of a U-shaped passage 91 formed from a wall 90 and a guide member 92. A further guide member 95 is disposed on a vertical wall 93 at the air outlet side of the passage 91 in such a manner that there is a passage between the guide members 92 and 95 and between the guide member 95 and the wall 90 of the passage 91.

Figure 1:
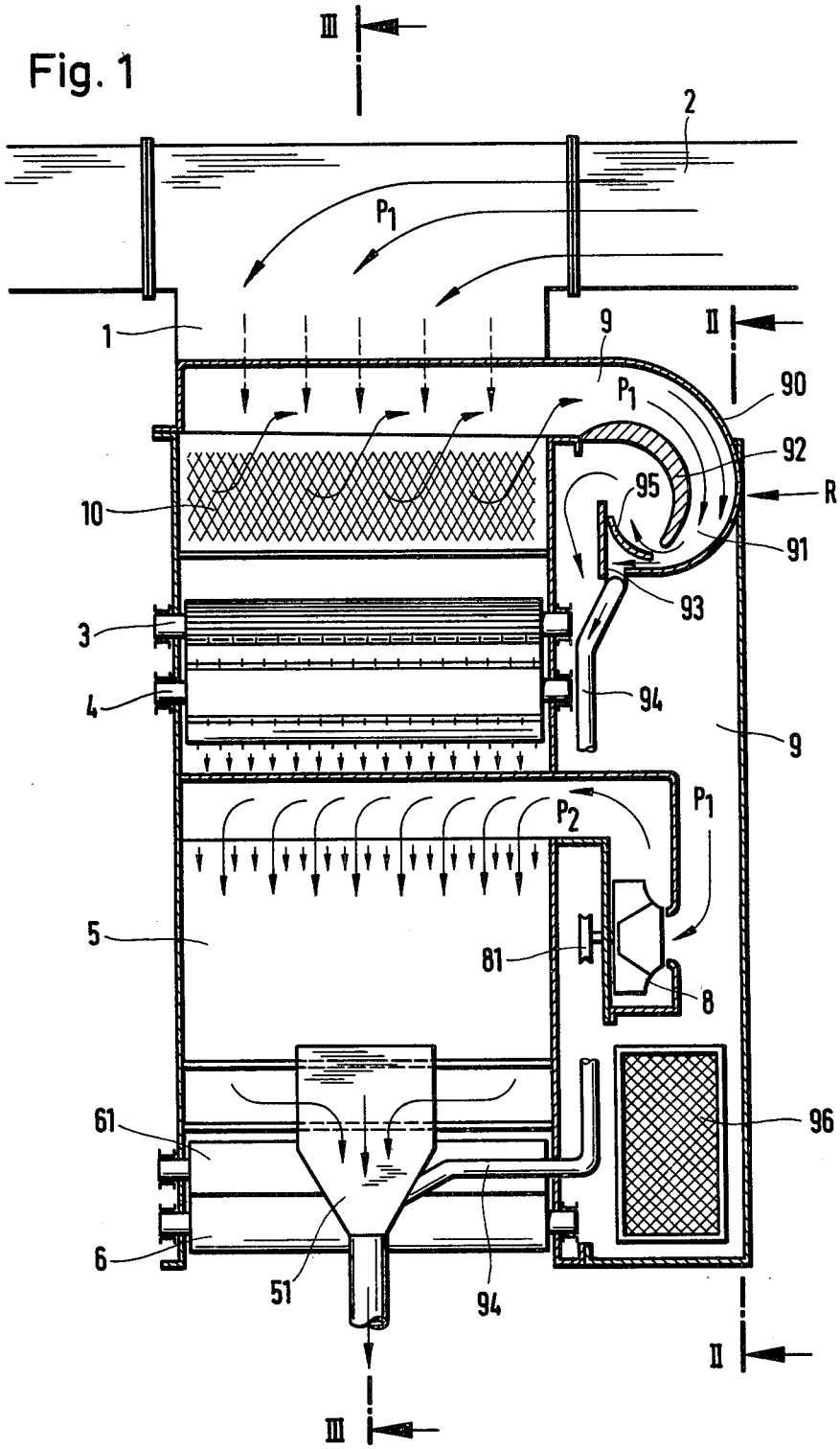
FIG. 1 is a side elevational view in section illustrating a feed apparatus constructed in accordance with the present invention.

As can be seen from FIG. 1, the stream of air $P_1$ guided at first substantially horizontally from the air circulating passage 9 is deflected downwards by the passage 91. As a result of the deflection, the impurities reach the outer marginal region of the stream of air $P_1$. They slide along the wall 90 and then pass through the passage between the guide member 95 and the wall 90, while the stream of air $P_1$ flows through the passage between the air elements 92 and 95 into the portion of the air circulating passage 9 following the cleansing device R and flows on, in this, to the intake side of the blower 8. The impurities thus separated out of the stream of air $P_1$ enter the the chamber formed by the wall 90, the vertical wall 93, and the guide member 95 and are removed from this through a pipeline 94 which is connected to the cleansing device R and leads into the pipeline 51 leading to the card extractor.

The arrangement of the air circulating passage 9 and the air circulation caused thereby is not restricted to a feed apparatus wherein the stream of air for compressing the fiber material is produced continuously by a blower, but may also be effected to advantage, for example, in an apparatus with a stream of compression air produced intermittently by a piston or the like displaced in a cylinder.

In cases where the filling of the feed shaft 1 fluctuates to a large extent and the stream of air $P_1$ therefore varies accordingly, a bypass 96 is provided in the air circulating passage 9 to balance the air regulation, through which bypass a limited amount of air can be drawn in from the spinning room or delivered to this. The surface of the bypass consists of a filter mat so that the air drawn in is subjected to cleansing.

While a preferred embodiment of the invention has been described using specific terms, such description is for illustrative purposes only, and it is to be understood that changes and variations may be made without departing from the spirit or scope of the following claims.

What is claimed is:

1. An apparatus for feeding a carding machine with fiber material, having a filling shaft which is fed via a preceding feed shaft, the fiber material being conveyed into the feed shaft by means of a stream of air flowing through a conveying conduit and said stream of air used for conveying said fibers to said feed shaft enemerging from said feed shaft, said apparatus comprising:

an air circulating passage connecting said feed shaft to said filling shaft, said stream of air emerging from said feed shaft being conveyed into said filling shaft through said air circulating passage for compressing the fiber material therein, and an air cleansing device disposed in said air circulating passage for cleaning said stream of air emerging from said feed shaft.

2. The apparatus as set forth in claim 1 further comprising:

an air conveying device disposed in said air circulating passage for conveying said stream of air emerging from said feed shaft into said filling shaft.

3. The apparatus as set forth in claim 1 wherein said cleansing device comprises:

an air deflection device for separating impurities from said air stream.

4. The apparatus as set forth in claim 3 further comprising:

a pipeline connected to said cleansing device for removing said impuriries separated out.

5. An apparatus for feeding a carding machine with fiber material comprising:

a feed shaft, a pipeline connected to said feed shaft, air stream means for conveying fiber material into said feed shaft via said pipe line, a filling shaft disposed downstream of said feed shaft having an opening in a wall thereof, roller means arranged between said feed shaft and said filling shaft for feeding fiber material from said feed shaft into said filling shaft, an opening in a lower portion of said feed shaft through which said air stream being fed into said feed shaft emerges, an air circulating passage connecting said opening of said feed shaft to said opening in said filling shaft below said roller means, and said stream of air emerging from said opening in said feed shaft being conveyed into said filling shaft through said air circulating passage and said opening in said filling shaft for flowing downstream through said fiber material in said filling shaft and compressing said fiber material therein.

* * * * *